United States Patent [19]

Neiser

[11] 4,078,658

[45] Mar. 14, 1978

[54] CARRIER FOR HANDLING AND TRANSPORTING POTTED PLANTS

[76] Inventor: J. Ray Neiser, 7503 S. M St., Tacoma, Wash. 98408

[21] Appl. No.: 742,762

[22] Filed: Nov. 18, 1976

[51] Int. Cl.[2] ..... B65D 85/50; B65D 85/52

[52] U.S. Cl. ..... 206/423; 229/41 B

[58] Field of Search ..... 206/423, 491, 486, 45.14, 206/45.19, 303; 229/40, 41 B; 428/23

[56] References Cited

U.S. PATENT DOCUMENTS

| | | | |
|---|---|---|---|
| 2,033,526 | 3/1936 | Kinkeman | 206/45.14 |
| 2,274,253 | 2/1942 | Howell | 206/45.14 |
| 2,646,202 | 7/1953 | Gibbons | 229/40 |
| 2,646,915 | 7/1953 | Bockman | 229/41 B |
| 2,950,041 | 8/1960 | Stone | 229/40 |
| 3,722,781 | 3/1973 | Page | 229/30 |

*Primary Examiner*—Herbert F. Ross

*Attorney, Agent, or Firm*—Christensen, O'Connor, Johnson & Kindness

[57] ABSTRACT

A cardboard carrier for maintaining potted plants upright during shipment and handling is disclosed. The carrier is formed from a flat, rectangular cardboard blank having four parallel spaced apart fold lines that partition the blank into five rectangular panels. The carrier is assembled without staples or other fasteners by folding the blank about each fold line so that the central panel forms the bottom of the carrier, each panel contiguous to the central panel forms a side of the carrier and one of the outermost panels is superposed on the other outermost panel to form the top of the carrier. Each of the outermost panels include a circular central opening having inwardly extending tabular regions about the circumference thereof. The central openings come into alignment with one another when the container is folded so that a single circular opening having four equally spaced apart, inwardly extending tabular regions is formed. The potted plant is placed in the opening with the tabular regions contacting the walls of the pot or a decorative wrapping that is often placed around such potted plants. To support the superposed upper panels of the folded container substantially parallel to the bottom panel, one of the upper panels includes two tabular regions that are bent angularly downward to form braces that extend between the superposed upper panels and the lower panel.

7 Claims, 5 Drawing Figures

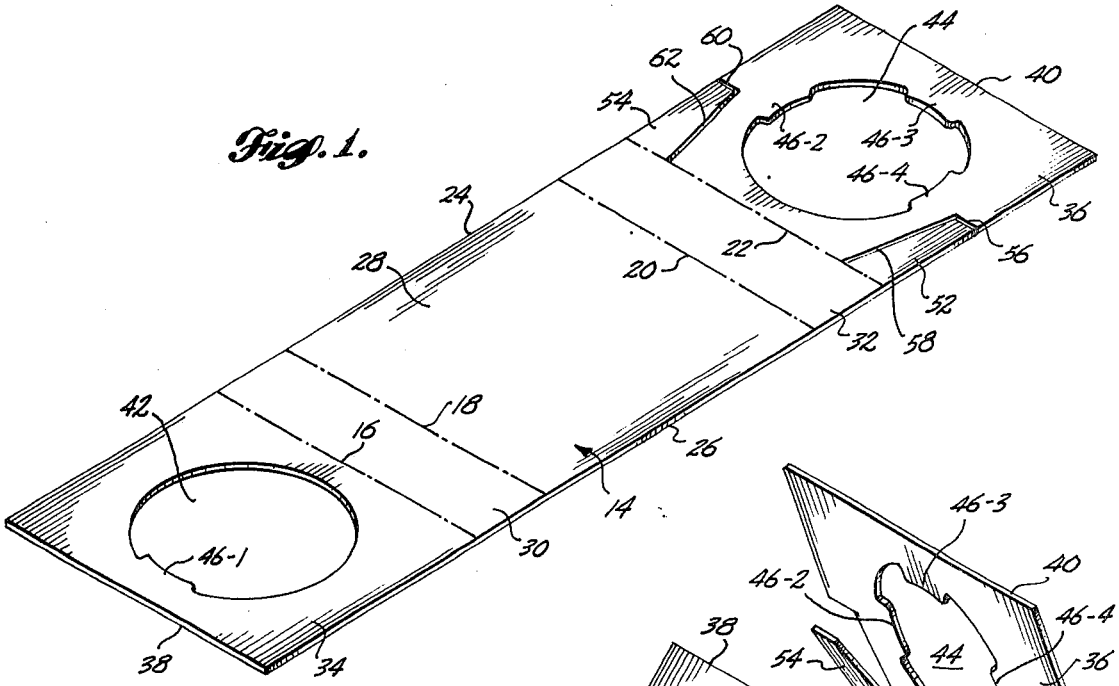
Fig. 1.
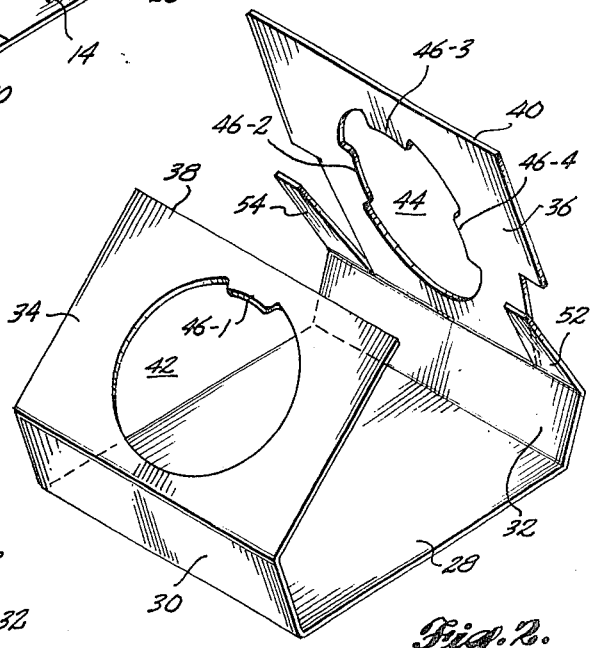
Fig. 2.
Fig. 3.
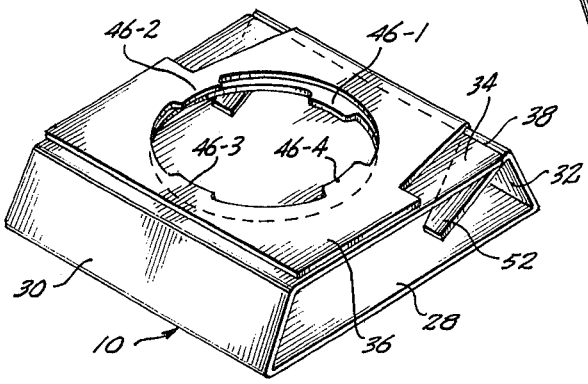
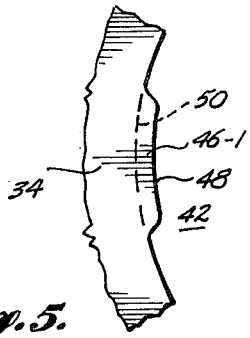
Fig. 5.
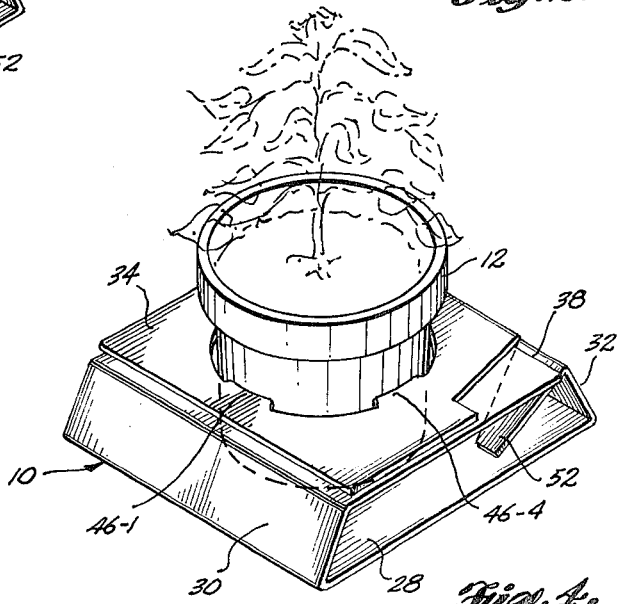
Fig. 4.

CARRIER FOR HANDLING AND TRANSPORTING POTTED PLANTS

BACKGROUND OF THE INVENTION

Quite often growing plants or floral arrangements are sold and delivered in inverted frustoconical containers that are commonly called flower pots. For example, plants are often grown in such containers formed of clay, plastic or other material and sold as potted plants with such potted plants being delivered to the customer at the florist's place of business or being delivered to some destination designated by the customer. Since the foliage of a potted plant is often rather extensive and the base of the flower pot containing the potted plant does not encompass a large area, potted plants generally have a relatively high center of gravity and are susceptible to tipping. If, as is generally the case, the potted plant is transported with a delivery truck, or a customer's vehicle, great care must be exercised in the handling and transportation so that the plant or flower pot is not damaged due to tipping over.

Although it is possible for a florist to equip his delivery trucks for supporting potted plants and the like, such an arrangement requires a substantial investment and detracks from the versatility of the delivery vehicle in that florists often deliver floral arrangements other than those contained in flower pots, e.g., cut flowers contained in boxes. Further, such an arrangement is of no avail to customers that accept delivery of potted plants at a florist shop and must transport the plants in their own vehicles.

Although various portable containers or carriers for potted plants and the like have been provided within the prior art, such containers or carriers have presented a number of disadvantages. First, if such containers are configured for use by the florist without any assembly operations, the containers generally require a great deal of storage space. On the other hand, if the container is configured for fabrication by the florist, the prior art containers generally require a substantial amount of time and effort to assemble, often requiring gluing or fastening operations such as taping or stapling.

Secondly, many such prior art containers are relatively expensive. Hence, such a container may be advantageous to the florist for his own delivery operation wherein he may reuse the container for a number of delivery operations, but does not facilitate transportation of potted plants by a customer unless the florist prices the merchandise to include the transportation carriers.

Accordingly, it is an object of this invention to provide a carrier or container for potted plants and the like which will maintain the potted plant upright during delivery thereof, and which will ensure delivery in an undamaged condition.

It is a further object of this invention to provide a carrier or container for potted plants that will not only maintain the floral container in an upright position during delivery, but make it easier to handle such floral deliveries.

It is another object of this invention to provide a container for the delivery and handling of potted plants and the like that requires minimal storage space and minimal time and effort to assemble to thereby save packing time during the preparation of a potted plant for shipment or delivery.

It is yet another object of this invention to provide a blank that can be readily assembled into a container for the transportation and handling of a potted plant without the use of staples or other conventional fastening devices.

It is still another object of this invention to provide an economically manufactured carrier for potted plants that is expendible, yet rugged enough to be used on several occasions if so desired.

SUMMARY OF THE INVENTION

These and other objects are achieved in accordance with this invention by a unitary blank that is readily foldable to form a carrier for receiving and containing a potted plant during the shipment and handling of the plant. The blank is substantially rectangular in shape and includes four spaced apart fold lines that are substantially parallel to one another and partition the blank into five rectangular panel regions. The centermost panel region forms the bottom or base of the carrier with each of the two panels that are contiguous to the centermost panel being folded about the two innermost fold lines to project upwardly and form oppositely disposed side panels. Each of the outermost panels fold about the two outermost fold lines such that one of the outermost panels rests on the other in a contacting superposed relationship wherein both the outermost panels are substantially parallel to the bottom panel.

An opening, dimensioned for receiving a flower pot containing a plant or floral arrangement, is located in the central region of each of the outermost panels. As the blank is folded to position one of the outermost panels on top of the other, the two openings come into alignment and the flower pot is inserted through the opening such that the base of the flower pot rests on the bottom panel and the aligned circular openings encompass and support the flower pot.

Preferably, the openings are substantially circular in shape with tabular regions of the outermost panels extending radially inward toward the central region of each opening. These tabular regions are preferably arranged such that, when the outermost panels are folded one upon the other, the tabular regions are evenly spaced around the periphery of the opening formed by the aligned openings of the outermost panels. Each tabular region is dimensioned to contact (or be in close proximity with) the outer surface of the flower pot. Further, each tabular region is smoothly contoured to prevent damage to decorative foil or cellophane wrapping that is commonly placed about flower pots containing floral arrangements or potted plants.

To support the two outermost panels in parallel spaced relationship with the bottom panel, two tabs are cut away from the outermost panel that is folded on top of the other outermost panel. Each of these tabs is located adjacent to the fold line that separates that outermost panel from the adjacent side panel with each tab being folded to extend angularly downward from the upper edge of the side panel and contact the upper surface of the bottom panel. When the blank is folded to form the carrier, the tabs are bent downwardly to contact the lower panel and effectively form a ramp-like brace along two corner regions of the carrier. One outermost panel is swung downwardly so that the outer edge thereof rests on and is supported by the tabs, and the second outermost panel from which the tabs are cut is then folded over the first outermost panel.

Since the blank is flat and substantially rectangular in shape, the unassembled carriers can easily be stored in neat stacks. Further, since the carrier is formed by a relatively simple folding operation — without stapling, gluing or taping — the carrier can be quickly assembled whenever needed. Preferably, in the practice of this invention, the blank is cut from conventional corrugated cardboard. Since such material is relatively inexpensive, yet is relatively waterproof, the carriers are expendable after a single use or can be reused if desired.

BRIEF DESCRIPTION OF THE DRAWINGS

FIG. 1 is an isometric view of a blank for forming a container or carrier for potted plants in accordance with this invention;

FIG. 2 is an isometric view illustrating the folding operation utilized in forming a potted plant container from the blank depicted in FIG. 1;

FIG. 3 is an isometric view depicting the embodiment of FIG. 1 in a completely folded condition;

FIG. 4 is an isometric view of the folded container of FIG. 3 depicting the placement of a flower pot within the container; and FIG. 5 is a partial plan view of the blank depicted in FIG. 1 illustrating the tabular projections for supporting the flower pot within the folded container.

DETAILED DESCRIPTION

As depicted in the drawing, a container or carrier 10 (FIGS. 3 and 4) for receiving and supporting a flower pot 12 is formed from a unitary blank 14 (FIG. 1). As shall be described hereinafter, the container 10 is formed without the use of fasteners such as staples or glue and provides advantageous means for supporting and protecting potted plants during periods of handling and transit.

Referring to FIG. 1, the blank 14 is substantially rectangular in shape and includes four spaced apart lines 16, 18, 20, and 22. Preferably, the blank 14 is formed from conventional corrugated cardboard with the corrugations thereof substantially parallel to the longitudinal edges 24 and 26 of the blank 14. Other suitable materials can be employed and include plastic sheet material and paperboard material other than corrugated cardboard.

The fold lines 16 through 22 are substantially parallel to one another and substantially perpendicular to the longitudinal edges 24 and 26 of the blank 14. Each fold line structurally weakens a zone of the blank 14 such that the blank can easily be folded or pivoted upwardly about a fold line.

Techniques for forming such fold lines are well known in the art. For example, corrugated cardboard blanks are generally creased along such fold lines by a creasing machine to collapse the corrugations and render the blank easily foldable about a shallow indentation formed by the creasing operation. In a similar manner, blanks made of plastic sheet material are often scored along such a fold line by cutting a narrow, shallow groove in the surface of the blank or, in the case of thermoplastic materials, forming such a groove by heating a narrow strip of the blank.

Regardless of the type of material employed in the construction of the blank 14, or the manner in which the fold lines 16 to 22 are formed, the fold lines partition the blank 14 into five substantially rectangular regions for forming a bottom panel, two oppositely disposed side panels and an upper panel when the blank 14 is folded to form the container 10. More explicitly, a rectangular bottom panel 28 is defined between the longitudinal edges 24 and 26 and the fold lines 18 and 20; a first side panel 30 is defined between the longitudinal edges 24 and 26 and the fold lines 16 and 18; a second side panel 32 is formed between the edges 24 and 26 and the fold lines 20 and 22; a first upper panel 34 is defined between the edges 24 and 26, the fold line 16, and a minor edge 38 of the blank 14; and, a second upper panel 36 is formed between the edges 24 and 26, the fold line 22, and a second minor edge 40 of the blank 14. Generally, the fold lines 16, 18, 20 and 22 are arranged such that the first and second upper panels 34 and 36 are of approximately equal longitudinal dimension, such longitudinal dimension normally being somewhat less than the longitudinal dimension of the lower panel 28. Additionally, the fold lines 16, 18, 20 and 22 are positioned such that the side panels 30 and 32 are of equal longitudinal dimension. With this arrangement, when the blank 14 is folded to form the container 10 (FIGS. 3 and 4), the side panels 30 and 32 are oppositely disposed relative to one another and extend upwardly from the bottom panel 28 at an acute angle relative to the upper surface of the bottom panel 28. Further, the first upper panel 34 is folded about the fold line 16 and the second upper panel 36 is folded about the fold line 22 such that the second upper panel 36 assumes a superposed contacting relationship with the first upper panel 34.

Substantially circular cut-outs or openings 42 and 44 are respectively located in the central region of the first upper panel 34 and the second upper panel 36. In each embodiment of the invention, the openings 42 and 44 are sized to accomodate a range of flower pot diameters. As shown in FIGS. 3 and 4, the openings 42 and 44 come into alignment with one another to effectively form a single opening when the blank 14 is folded to form the container 10. Each circular opening 42 and 44 includes one or more tabular projections that extend inwardly toward the center of the respective opening. For example, in FIG. 1, the tabular projection 46-1 is a region of the first upper panel 34 that extends radially inward toward the central region of the opening 42 with the tabular projection 46-1 being located along a portion of the circumference of the opening 42 that is nearestmost the edge 38 of the blank 14. In the arrangement of FIG. 1, the opening 44 of the second upper panel 36 includes three spaced apart tabular projections 46-2, 46-3, and 46-4. Each of these tabular projections is defined by an inwardly extending portion of the second upper panel 36. In particular, the tabular projection 46-3 is located along a portion of the circumference of the opening 44 that is nearestmost the edge 40 of the blank 14 and each tabular projection 46-2 and 46-4 is spaced from the tabular projection 46-3 such that the midpoints of the tabular projections 46-2, 46-3 and 46-4 are approximately spaced at 90° intervals along the circumference of the opening 44. As can be seen in FIG. 3 when the blank 14 is folded to form the container 10, the tabular projections 46 are equally spaced from one another along the periphery of the opening formed by the alignment of the openings 42 and 44.

In accordance with this invention, the tabular projections 46 are preferably dimensioned to effectively contact or be in close proximity to the sidewalls of the flower pot 12 when the flower pot is inserted through the openings 42 and 44 as shown in FIG. 4. Although various numbers of tabular projections 46 can be employed and the tabular projections can be arranged in various manners, it is advantageous to utilize at least one tabular projection 46 located along a peripheral region of the opening 42 that is near the edge 38 of the blank 14 and at least one tabular projection 46 located along a portion of the periphery of the opening 44 that is near the edge 40 of the blank 14. When such an arrangement is employed, resiliency of the blank 14, which causes the container 10 to have a tendency to unfold, causes the tabular projections 46 of the first and second upper panels 34 and 36 to grip the outer surface of the flower pot 12. For example, in the depicted arrangement, because the container 10 has a tendency to unfold, the tabular projections 46-1 and 46-3 are forced toward one another and hence grip the sides of the flower pot 12. In this respect, it can be recognized that when a flower pot 12 is placed within the container 10, the pot 12 effectively becomes a structural member of the container. Further, it can be realized that this aspect of the invention permits a range of flower pot diameters to be accomodated by each embodiment of the invention.

As is shown in more detail in FIG. 5, each tabular projection 46 is shaped to prevent damage to decorative wrappings such as aluminum foil or colored cellophane wrapping material that is often placed around a flower pot to improve the appearance of a potted plant. Each tabular projection 46 includes a curved inner edge 48 having a center of curvature substantially identical to the center of the associated circular opening 42 or 44 and a radius of curvature less than the radius of the associated circular opening. Thus, with respect to the tabular projection 46-1 of FIG. 5, the tabular projection 46-1 extends inwardly a distance equal to the difference between the radius of the circular opening 42 and the radius of curvature of the curved edge 48.

Each end of the curved inner edge 48 is smoothly contoured or radiused to prevent the formation of sharp corners that could damage decorative wrappings placed around the potted plant that is to be transported within the container 10. The tabular projections 46 are normally dimensioned such that the curved inner edge 48 has a radius of curvature substantially equal to a standard sized flower pot and extend inwardly in coplanar relationship with the associated upper panel 34 or 36 to either contact the flower pot walls or lie in close proximity thereto so as to prevent the contained potted plant from tipping over. In some embodiments, however, it may be advantageous to score the associated upper panel 34 and 36 of the tabular projections 46 along the major circumference of the circular opening 42 or 44 such that the tabular projections can be bent slightly downward toward the bottom panel 28 if the inserted flower pot should have a slightly larger radius than the radius of curvature of the inner edge 48 of the tabular projections 46. For example, in FIG. 5, the surface of the upper panel 34 can be creased or lightly scored along the line 50 to suitably weaken the panel 34 so that the tabular projection 46-1 can be bent downwardly by a flower pot being inserted into a opening 42. In any case, as can be seen in FIG. 4, when a flower pot 12, containing a potted plant or other floral arrangement is inserted through the opening 42 (and the aligned opening 44), the tabular projections 46 extend inwardly toward the outer wall of the pot and prevent the pot from tipping over.

Referring again to FIG. 1, the blank 14 preferably includes two tabular regions 52 and 54 that form supports for the upper panel 34 of the folded container 10. Each tabular region 52 and 54 is located along the fold line 22 and is cut from the upper panel 36. In particular, the tab 52 is bounded by the fold line 22, the longitudinal edge 26 of the blank 14, and by two edges 58 and 56 that are formed by cutting through the upper panel 36. The edge 56 is cut into the panel 36 substantially parallel to the fold line 22 to extend substantially perpendicular from the longitudinal edge 26 toward the opening 44 and the edge 58 is cut into the panel 36 to extend from a point along the fold line 22 to the innermost end of the edge 56. The tab 54 is formed in a substantially identical manner by the fold line 22, the longitudinal edge 24 of the blank 14 and by the edges 60 and 62 that are cut into the upper panel 36, with the edge 60 being substantially parallel to the fold line 22 and the edge 62 extending from the fold line 22 to the innermost point of the edge 60. Each tab 52 and 54 is dimensioned to extend angularly downward from the fold line 22 when the blank is folded to form the container 10 with the edges 56 and 60 contacting the surface of the bottom panel 28.

When the blank 14 is assembled to form the container 10, the blank is folded upwardly about the fold lines 18 and 20, the tabs 52 and 54 are folded downwardly about the fold line 22, the upper panel 34 is folded downwardly about the fold line 16, and the upper panel 36 is folded downwardly about the fold line 22 (FIG. 2). As is shown in FIGS. 2 and 3, this folding operation is performed such that the side panel 32 extends upwardly from the bottom panel 28 to form an acute angle therewith, with the tabs 52 and 54 extending from the upper edge of the side panel 32 to the upper surface of the bottom panel 28. In a similar manner, the side panel 30 is folded to extend upwardly from the bottom panel 28 forming an acute angle with the bottom panel. The upper panel 34 is folded about fold line 16 such that the upper panel 34 extends substantially parallel to the bottom panel 28 with the edge 38 of the upper panel 34 resting on and supported by the downwardly extending tabs 52 and 54. The upper panel 36 is folded about fold line 22 to rest on or overlap the upper panel 34 and the opening 44 is brought into alignment with the opening 42. Although the upper panels 34 and 36 can be stapled together to maintain the blank 14 in this assembled configuration, it has been found advantageous to simply place the flower pot 12 into the opening formed by the aligned openings 42 and 44. In effect, in such an arrangement, the flower pot 12 becomes a structural member of the container 10 in that the pot 12 prevents the blank 14 from unfolding. Thus any tendency of the blank 14 to unfold causes the tabular projections 46 that are adjacent to the minor edges 38 and 40 of the blank 14 to rather firmly grasp the exterior surface of the flower pot 12. Further, in such an arrangement, the flower pot 12 can be easily removed when the potted plant or floral arrangement reaches the delivery point and if desired, the blank 14 can be stored in a flat condition for use at a later time.

It will be recognized by those skilled in the art that the disclosed embodiment is exemplary in nature and that many variations are within the scope and spirit of this invention. For example, although the depicted embodiment is formed such that the side walls 30 and 32 extend angularly between the bottom panel 28 and the upper panels 34 and 36 — to thereby provide a relatively large bottom panel while minimizing the amount of material required to form the container 10 — the blank 14 can be configured such that the side panels 30 and 32 extend substantially perpendicular to the bottom panel 28.

What is claimed is:

1. A carrier for transporting and handling a plant container comprising a blank having four spaced apart zones of weakness extending transversely of said blank, said zones of weakness being substantially parallel to one another to partition said blank into five contiguous panel regions for forming a bottom panel, first and second side panels and first and second upper panels when said blank is folded upwardly about said zones of weakness, each of said upper panels including an opening centrally located therein, each of said openings sized and constructed to engagingly receive a plant container, said blank being foldable about said zones of weakness to position said first and second upper panels in superposed juxtaposition with one another to align said openings of said upper panels for the insertion of a plant container, said superposed first and second upper panels being spaced apart from said bottom panel by said first and second side panels when said blank is folded, said first upper panel of said blank including at least one support brace for supporting said first and second upper panel when said blank is folded, each of said support braces being a tabular region of said first upper panel with one edge of said tabular region defined by that zone of weakness separating said first upper panel from the adjacent one of said first and second side panels, each of said tabular regions being foldable about said zone of weakness to angularly position each of said braces between the upper surface of said bottom panel and said zone of weakness, said second upper panel being foldable to rest upon each of said angularly extending tabular regions, said first upper panel being foldable to position said first panel in superposed juxtaposition with said second upper panel for aligning said openings of said first and second upper panels.

2. The carrier of claim 1 wherein each of said openings of said first and second upper panels are substantially circular, each of said openings including at least one tabular region extending inwardly toward the central region of said opening, said tabular regions dimensioned and arranged for supporting a plant container when said blank is folded and said plant container is inserted in said aligned openings of said first and second upper panels.

3. The carrier of claim 1 wherein said bottom panel, said first and second side panels and said first and second upper panels are dimensioned and arranged such that each of said side panels extend upwardly at an acute angle relative to said bottom panel with said blank is folded to form said carrier.

4. A unitary blank of sheet material having a substantially rectangular planar geometry foldable to form a carrier for transporting and handling potted plants, said rectangular blank including four substantially parallel, spaced apart fold lines that are substantially perpendicular to a first and second oppositely disposed longitudinal edge of said rectangular blank, said fold lines partitioning said blank into a bottom panel, first and second side panels, and first and second upper panels, said bottom panel being the centermost portion of said blank, said first and second side panels being respectively contiguous to said bottom panel along the first and second of said fold lines, said first and second upper panels being respectively contiguous to said first and second side panels along a third and fourth of said fold lines, said first and second upper panels respectively including a centrally located first and second opening of substantially identical geometry, said second upper panel including first and second tabular braces integrally formed therein, said first tabular brace having a first edge substantially parallel to said fourth fold line and extending a predetermined distance inwardly into said second upper panel from said first longitudinal edge of said blank, a second edge extending from a predetermined point along said fourth fold line to the inward termination of said first edge of said first tabular brace and a third edge defined by a portion of said first longitudinal edge of said blank, said second tabular brace having a first edge substantially parallel to said fourth fold line and extending inwardly a predetermined distance from said second longitudinal edge of said blank, a second edge extending from a predetermined point along said fourth fold line to the inward termination of said first edge of said second tabular brace, and a third edge defined by a portion of said second longitudinal edge of said blank, said first and second side panels being positionable to project upwardly from said bottom panel by folding said first and second side panels about said first and second fold lines, said first and second tabular braces being foldable about said fourth fold line to extend angularly downward with said first edge of said first and second tabular braces contacting the upper surface of said bottom panel when said second side panel is folded upwardly about said third fold line to place one edge of said first upper panel in contact with said angularly extending first and second tabular braces when said first side panel is folded upwardly about said first fold line, said second upper panel being foldable about said fourth fold line to align said first and second openings for receiving said potted plant with said second upper panel in superposed juxtaposition with said first upper panel and said superposed first and second upper panels extending substantially parallel to said bottom panel.

5. The blank of claim 4 wherein first and second openings are of substantially circular geometry and said first and second upper panels include at least one tabular region projecting radially inward toward the center of said first and second circular openings, each of said tabular regions extending peripherally along a portion of the circumference of the respective one of said first and second circular openings, each said tabular projection having that edge of said tabular projection located nearestmost to the center of said circular opening contoured to correspond to the contour of a potted plant container insertable through said aligned circular openings.

6. The blank of claim 5 wherein said first upper panel includes a single tabular projection located along a portion of the periphery of said first circular opening that is oppositely disposed relative to said third fold line and said second upper panel includes a first, second and third tabular projection spaced along the periphery of said second opening, said first tabular projection of said second upper panel being located on a portion of said periphery of said second opening that is oppositely disposed relative to said fourth fold line, said second and third tabular projections being located along the periphery of said second opening with the center points of said second and third tabular projections being commonly located on a line orthogonally intersecting said first and second longitudinal edges of said blank and passing through the center of said second circular opening.

7. The blank of claim 4 wherein the longitudinal dimension of said first and second upper panels are substantially equal to one another and are less than the longitudinal dimension of said bottom panel to position each of said first and second side panels at an acute angle relative to said bottom panel when said blank is folded for receiving said potted plant.

* * * * *